US007921687B2

(12) United States Patent
Stretch

(10) Patent No.: US 7,921,687 B2
(45) Date of Patent: Apr. 12, 2011

(54) WHEEL RECONDITIONING METHOD AND APPARATUS

(75) Inventor: Robert G. Stretch, Arlington, TX (US)

(73) Assignee: P 5 Wheels, LLC, Dallas, TX (US)

( * ) Notice: Subject to any disclaimer, the term of this patent is extended or adjusted under 35 U.S.C. 154(b) by 735 days.

(21) Appl. No.: 11/850,471

(22) Filed: Sep. 5, 2007

(65) Prior Publication Data

US 2009/0056398 A1 Mar. 5, 2009

(51) Int. Cl.
*B21D 3/14* (2006.01)
*B21D 11/22* (2006.01)

(52) U.S. Cl. ..... 72/31.02; 72/311; 72/705

(58) Field of Classification Search ..... 72/31.02, 72/311, 316, 31.1; 29/894, 894.35, 894.351, 29/894.36, 894.361, 894.38; 269/60, 240, 269/250

See application file for complete search history.

(56) References Cited

U.S. PATENT DOCUMENTS

| | | | | |
|---|---|---|---|---|
| 2,282,118 | A | 5/1942 | Daniel | |
| 2,489,815 | A | 11/1949 | Rader | |
| 2,540,370 | A | 2/1951 | Jackson | |
| 3,855,831 | A | 12/1974 | Senkyrik | |
| 5,303,573 | A | 4/1994 | Douglas | |
| 5,499,524 | A | 3/1996 | Len | |
| 5,634,361 | A | 6/1997 | Herschman et al. | |
| 6,367,303 | B1 | 4/2002 | Hizono | |
| 7,018,156 | B2 | 3/2006 | Irby et al. | |
| 7,415,766 | B2 * | 8/2008 | Luschei et al. | 29/894.3 |
| 2004/0035164 | A1 | 2/2004 | Blaser, Jr. | |

* cited by examiner

*Primary Examiner* — Dana Ross
*Assistant Examiner* — Debra M Sullivan
(74) *Attorney, Agent, or Firm* — Klemchuk Kubasta LLP; Darin M. Klemchuk

(57) ABSTRACT

A wheel reconditioning apparatus provided. The wheel reconditioning apparatus includes a support frame upon which a base support plate is attached. A rotatable adapter plate is supported on the base support plate by a precision bearing for supporting the rotation of the adapter plate about the vertical axis of a mounted wheel. Adjustable chucks are set in place on the adapter plate. The disfigured wheel is mounted on the adjustable chucks and held in place by the chucks during the reconditioning process.

7 Claims, 4 Drawing Sheets

WHEEL RECONDITIONING METHOD AND APPARATUS

BACKGROUND

1. Field of the Invention

The present invention relates generally to vehicle repair and in particular to an apparatus for reconditioning disfigured wheels.

Within the vehicle repair industry, and in particular within the wheel repair market, the need exists to employ devices to salvage disfigured wheels. Conventionally wheels made of steel have been used for vehicles on which a tire is mounted about the wheel. Recently, however, new lightweight metals and metal alloys, such as aluminum, magnesium, and titanium, have been used for vehicle wheels. These new metals contribute to improved fuel efficiency, a more comfortable ride, and enhanced aesthetics. However, these wheels are frequently disfigured as a result of accident, such as the wheels coming into contact with curbing, encountering potholes in the roadway, rubbings against vehicle wash railings, and the like. While disfigured wheels were conventionally discarded, technology has improved within the vehicle repair industry that the disfigured wheels can now be reconditioned in many cases.

2. Description of Related Art

Various devices have been employed to recondition disfigured wheels. Examples of such devices are described in U.S. Pat. Nos. 3,855,831, 5,634,361, and 6,367,303. Most of the conventional devices used for reconditioning disfigured wheels employ a shaft support mechanism as a way to support the vehicle wheel during the reconditioning process. In addition to the shaft support mechanism, many of these conventional devices also contain an additional support column attached to the shaft support mechanism with bearings that allow the wheel to rotate during the reconditioning process. While the shaft support mechanisms initially support the wheel during the reconditioning process, the repeated stress of the forces applied to the wheel during the wheel reconditioning process eventually causes the shaft support mechanisms to become disfigured and fail for their intended purpose. The repeated stress of the forces applied to the wheel during the reconditioning process also cause the bearings to become disfigured so that the additional support column no longer rotates with ease. These problems with the conventional devices cause costly repair or replacement of the conventional wheel reconditioning devices.

For example, in U.S. Pat. No. 3,855,831 a wheel is mounted on the repair apparatus on a central shaft support mechanism. The central support mechanism supporting the wheel includes a perpendicular rotatable shaft support mechanism at the top of the central support mechanism that is supported by bearings to allow the wheel to spin during the repair process. The wheel is locked onto the rotatable support mechanism by bolts through the normal mounting holes of the wheel hub.

Under repeated stress from perpendicular or near perpendicular forces used to repair disfigured wheels, these shaft support mechanisms and the bearings supporting an additional support column used to rotate the wheel tend to become disfigured. When the shaft support mechanism or the bearings supporting an additional support column of a wheel repair device are disfigured, the wheel repair device can no longer be relied upon to return a wheel to its true form. The repair devices then must undergo costly replacement of the shaft support mechanism and the bearings supporting the additional support column or, in many instances, replacement of the wheel repair apparatus itself.

A need exists, therefore, for a wheel reconditioning apparatus that will support a disfigured wheel during the reconditioning process wherein the wheel is supported by the apparatus without using a shaft support mechanism. Such apparatus should support the disfigured wheel under forces used during the wheel reconditioning process to return the wheel to its true form. The apparatus should also provide for improved bearings and support of the bearings so that the apparatus is rotatable to allow the portion of the wheel that is disfigured to be reconditioned to its true form. Finally, the apparatus should allow for a variety of widths and diameters of the wheels so that the apparatus can be used to recondition any size wheel.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented with the wheel repair devices are solved by the apparatus of the present invention. In accordance with one embodiment of the present invention, a wheel reconditioning apparatus is provided. The apparatus includes a support frame upon which a base support plate is attached. A rotatable adapter plate is supported on the base support plate by a precision bearing for supporting the rotation of the adapter plate about the vertical axis of a mounted wheel. Adjustable wheel chucks are set in place on a chuck base that is set in place on the adapter plate. The disfigured wheel is mounted between the adjustable wheel chucks and held in place by the wheel chucks during the reconditioning process.

In accordance with another embodiment of the present invention, a wheel reconditioning apparatus is provided with a chuck apparatus fixed to an adapter plate that is rotatable in concert with the adapter plate about the fixed vertical axis of a wheel mounted on the wheel reconditioning apparatus. The adapter plate and chuck apparatus are fixed to mounting blocks and are supported on a base support plate by a precision bearing for supporting the rotation of the upper base and chuck apparatus. The base support plate is fixed to a support frame. The chuck apparatus includes a threaded insertion whereby a fitted bolt inserted into the threaded insertion in the chuck apparatus and turned causes the chuck slides on the chuck apparatus to move to the desired fit of the diameter of the rim of wheel.

In accordance with another embodiment of the present invention, wherein a chuck apparatus with threaded insert is included to move the chuck slides to the desired fit of the diameter of the rim of the wheel, it is possible to include a support for a pneumatic wrench on the adapter plate fitted so that a fitted bolt can be inserted into the threaded insertion of the chuck apparatus with pneumatic pressure from a pneumatic wrench.

In accordance with another embodiment of the present invention, the support frame includes a vertical support shaft that supports a hydraulic arm used to apply pressure to the disfigured wheel. Attached to the hydraulic arm is a ram that has a rounded edge in the approximate original form of the disfigured wheel. The vertical support shaft can be grooved so that the hydraulic arm is adjustable in a vertical direction and spring loaded into a groove along the vertical support shaft at the desired height.

Other objects, features, and advantages of the present invention will become apparent with reference to the drawings and detailed description that follow.

DETAILED DESCRIPTION OF THE PREFERRED EMBODIMENT

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
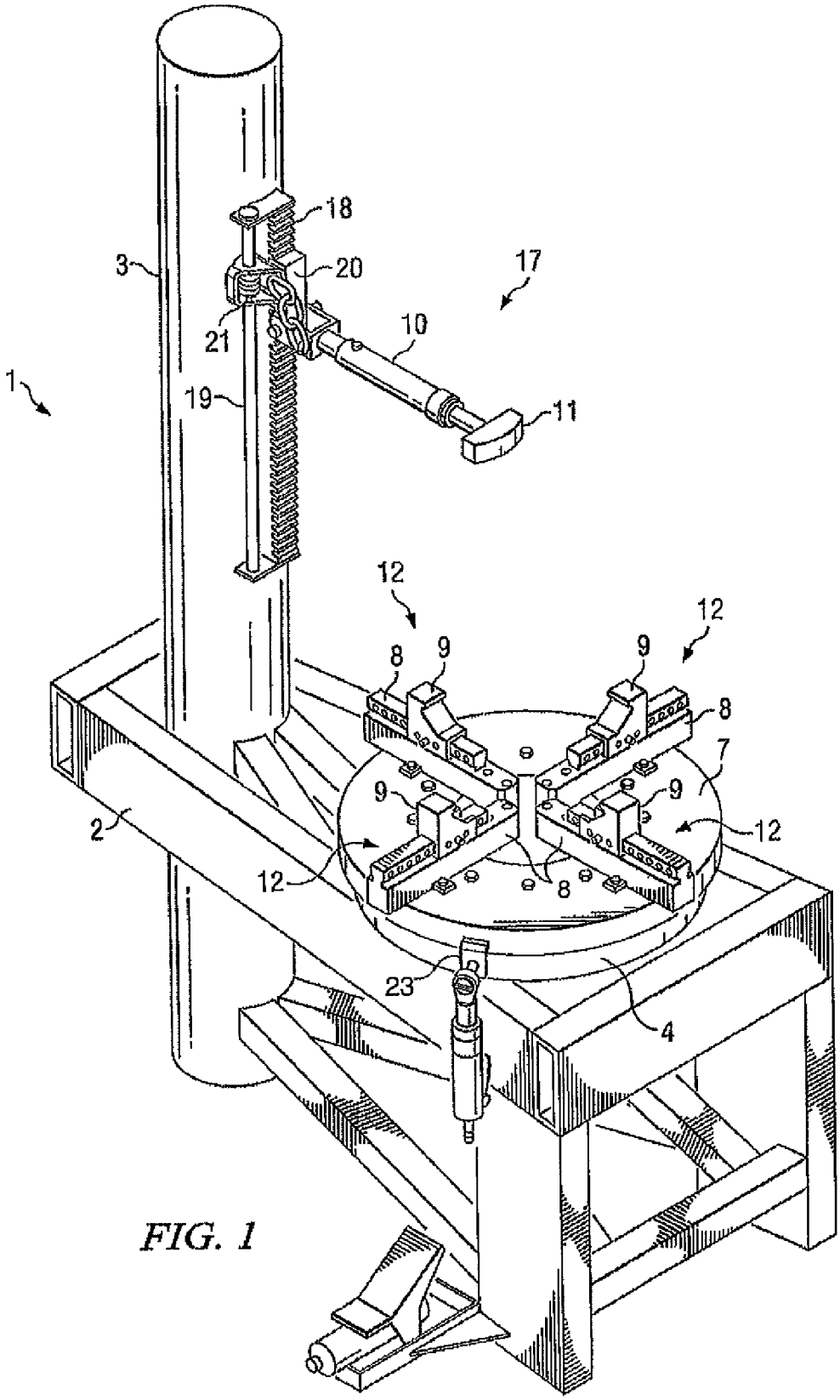
FIG. 1 is a perspective view of a wheel reconditioning apparatus in accordance with an embodiment of the present invention.

FIG. 1 is a perspective view of an embodiment of the present invention. In FIG. 1, the wheel reconditioning apparatus 1 includes a support frame 2 on which a base support plate 4 is fixed. A rotatable adapter plate 7 is fixed to mounting blocks, together supported on the base support plate 4 by a precision bearing 22 allowing the adapter plate 7 to rotate about the fixed vertical axis of wheel attached to the wheel reconditioning apparatus. The adapter plate 7 has a pneumatic wrench attachment 23 whereby a pneumatic wrench can be used to adjust the chuck base 8 to their desired position. Adjustable wheel chucks 9 are fixed to the chuck base 8, the chuck base 8 being set in place on the adapter plate 7 allowing wheels of differing diameters to be reconditioned. Included on the support frame 2 is a vertical support shaft 3 that supports a hydraulic arm assembly 17. The hydraulic arm assembly includes a hydraulic arm 10 that is fixed to the vertical support shaft 3. Attached to the hydraulic arm 10 is a ram 11 that is rounded to the approximate original form of a wheel. The hydraulic arm 10 and attached ram 11 are used to recondition a disfigured wheel to its approximate original form.

Figure 2:
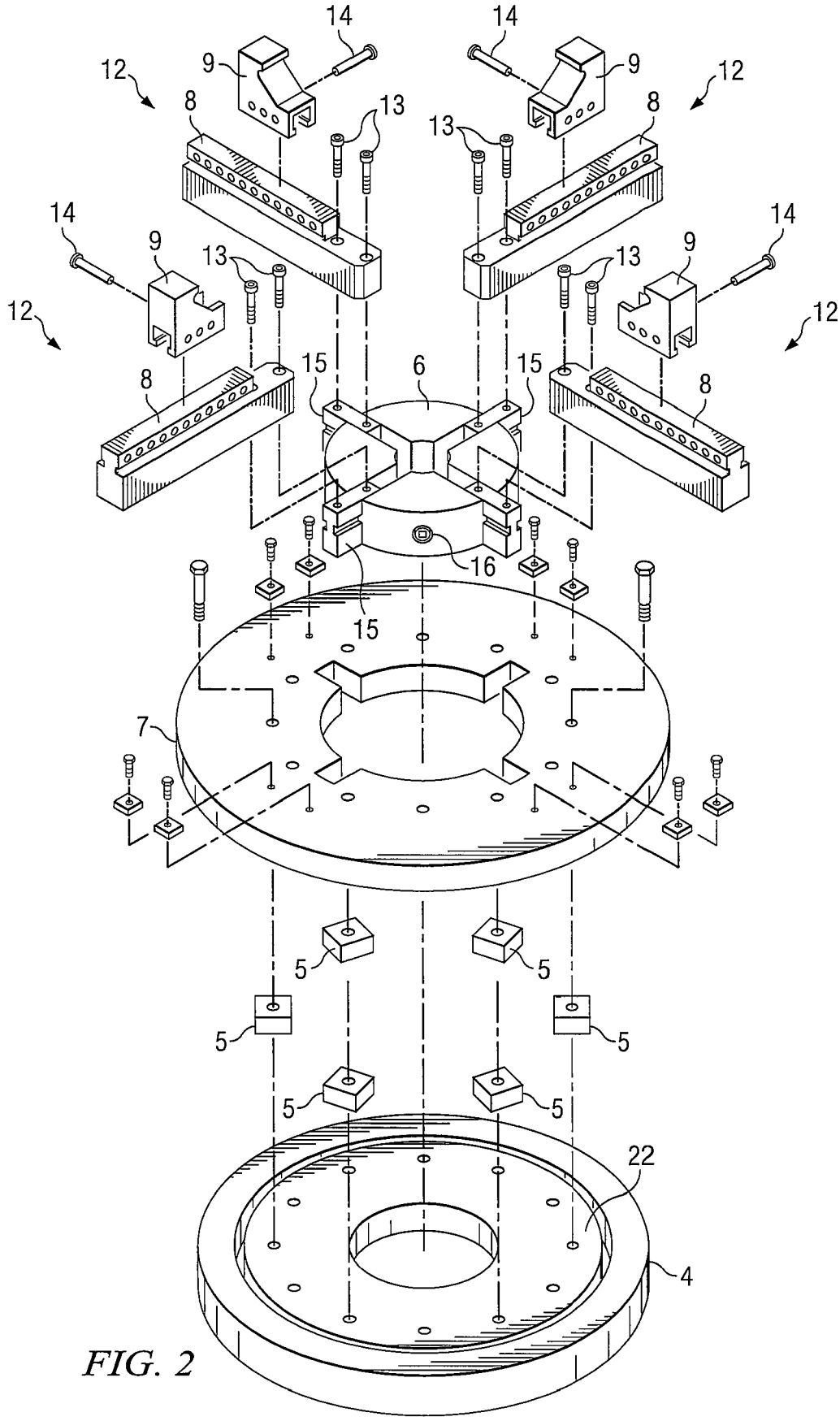
FIG. 2 is an exploded perspective view showing the base support plate, precision bearing, chuck apparatus, mounting block, adapter plate, and adjustable wheel chucks in accordance with an embodiment of the present invention.
Figure 3:
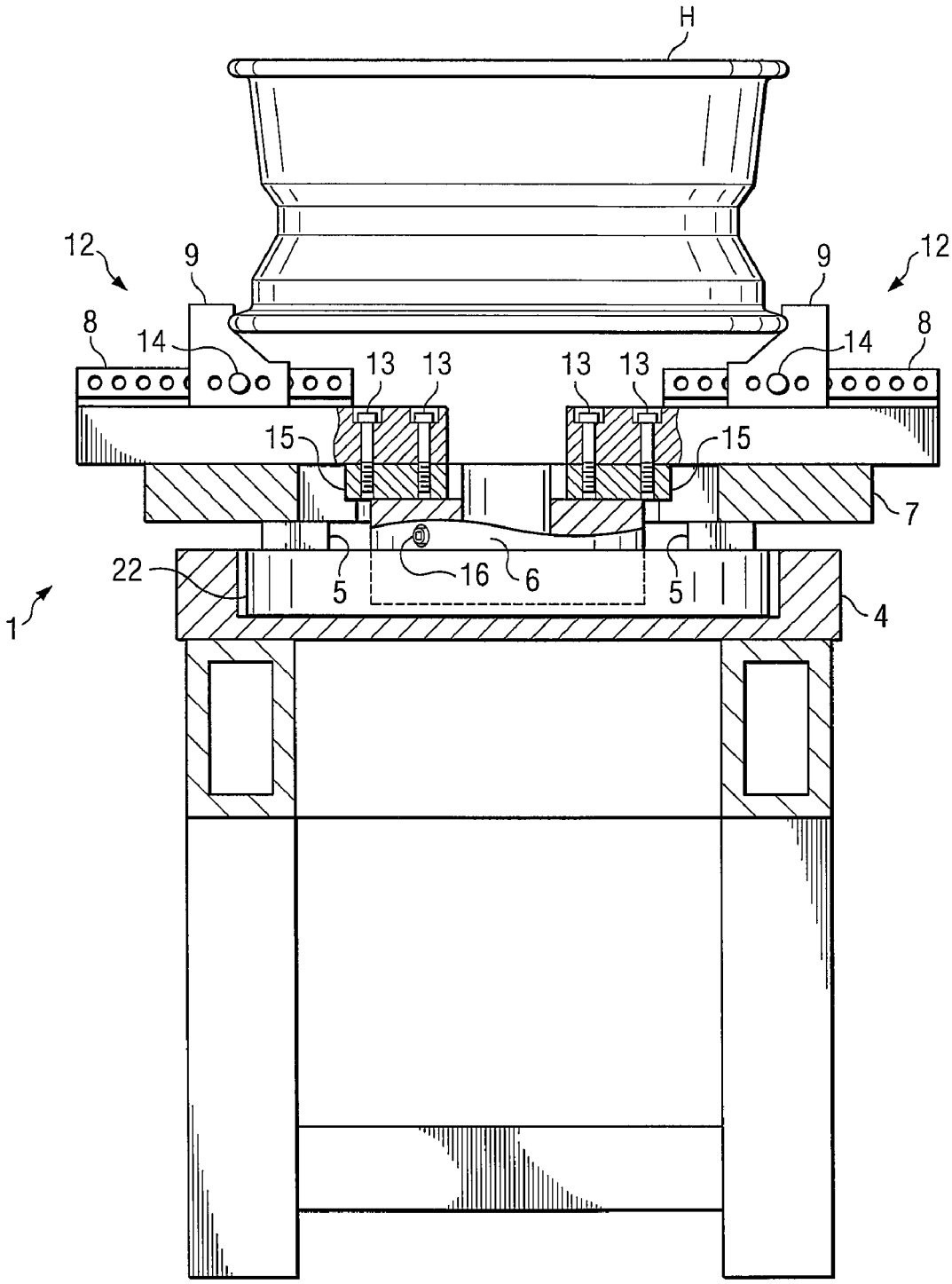
FIG. 3 is a sectional view showing the base support plate, precision bearing, chuck apparatus, mounting block, adapter plate, adjustable chucks, and wheel in the set position in accordance with an embodiment of the present invention.

FIG. 2 is an exploded perspective view showing the base support plate 4, precision bearing 22, chuck apparatus 6, adapter plate 7, and adjustable chuck assembly 12 in accordance with an embodiment of the present invention. FIG. 3 is a sectional view showing the same parts of the wheel reconditioning apparatus in the set position with a wheel H in place in accordance with an embodiment of the present invention.

In this embodiment of the present invention, the adjustable chuck assembly 12 includes a base chuck 8 that is fixed to the chuck apparatus 6 with two bolts 13. The adjustable wheel chuck 9 is fixed to the base chuck 8 with a pin 14 inserted through a hole in the adjustable wheel chuck 9 and matched to a hole in the base chuck 8. Each base chuck 8 is attached to a chuck slide 15 of the chuck apparatus 6 that can be moved laterally by the insertion of a fitted bolt in the threaded insertion 16. When a fitted bolt is entered into the threaded insertion 16 of the chuck apparatus 6, the chuck slides 15 will move laterally causing the adjustable chuck assembly 12 to either move toward or away from the wheel H (as shown in FIG. 3). The adjustable wheel chuck 9 is first fixed to the base chuck 8 according to the approximate diameter of the disfigured wheel H. The adjustable chuck assembly 12 is then tightened using a fitted bolt in the threaded insertion 16 of the chuck apparatus 6 to secure the disfigured wheel H in place. The adapter plate 7 is fixed to mounting blocks 5 that are fixed to the precision bearing 22. The precision bearing 22 in the present embodiment of the invention is a thrust bearing, but one skilled in the art will know that a variety of bearings can be used for the same purpose. The adapter plate 7, via mounting blocks 5, and the chuck apparatus 6 are supported on the base support plate 4 by a precision bearing 22 that allows the adapter plate 7 and chuck apparatus 6 to rotate about the vertical axis of the wheel H, allowing any portion of the wheel H that is disfigured to be reconditioned using the hydraulic arm assembly 17 referenced in FIG. 1.

Figure 4:
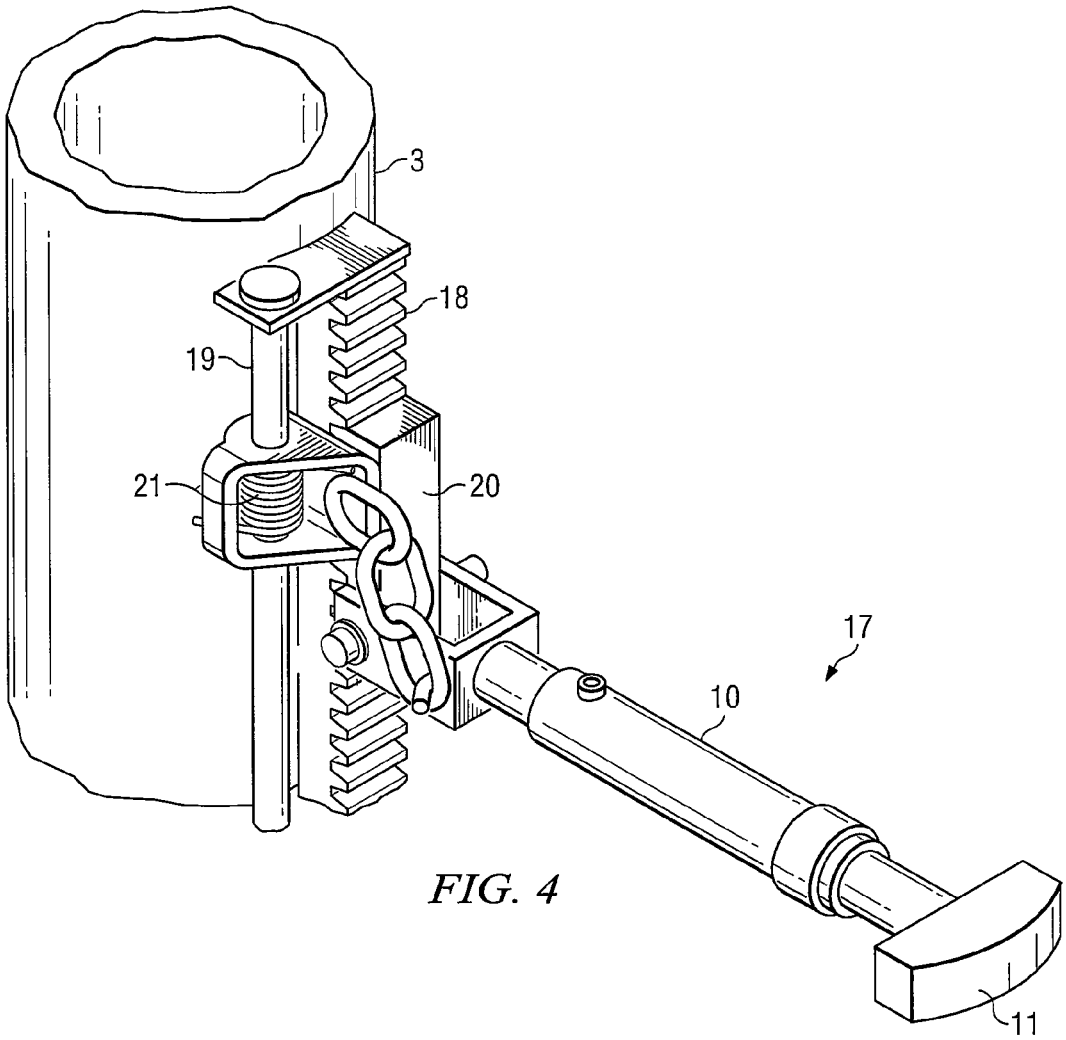
FIG. 4 is a perspective view of the vertical support shaft and hydraulic arm in accordance with an embodiment of the present invention.

FIG. 4. is a perspective view of the vertical support shaft 3 and hydraulic arm assembly 17 in accordance with an embodiment of the present invention. In FIG. 4 the vertical support shaft 3 contains grooves 18 to hold the hydraulic arm assembly 17 at a desired height. The hydraulic arm assembly 17 is attached to the vertical support shaft 3 by a metal casing 20 that is machined to fit the grooves 18 of the vertical support shaft 3, allowing the hydraulic arm assembly 17 to slide vertically up and down the support rod 19 when the metal casing 20 is not in contact with a groove 18 on the vertical support shaft 3. The metal casing 20 is attached to a spring assembly 21 around the support rod 19 that provides tension to keep the metal casing 20 in contact with a groove 18 on the vertical support shaft 3. By pulling the hydraulic arm assembly 17 and releasing the metal casing 20 from a groove 18 in the vertical support shaft 3, a technician can slide the hydraulic arm assembly 17 to the desired groove 18 in the vertical support shaft 3 such that the hydraulic arm assembly 17 is at the desired vertical height for reconditioning of a wheel.

According to an embodiment of the present invention, as shown in FIGS. 1 and 3, it is possible to repair the disfigured portion of a wheel H without the conventional adverse affects on the wheel mount device. According to an embodiment of the present invention, the disfigured wheel H is mounted on the adjustable wheel chucks 9. The adjustable chucks 12 include an adjustable wheel chuck 9 that is fixed to a base chuck 8. The adjustable chucks 12 are fixed to the chuck apparatus 6. The threaded insertion 16 of the chuck apparatus 6 is manipulated to allow the adjustable chucks 12 to secure the disfigured wheel H in place. The adapter plate 7 is fixed to mounting blocks 5 which are fixed to the precision bearing 22. The chuck apparatus 6 is placed within the adapter plate 7 and is also supported by the precision bearing 22. The adapter plate 7 and chuck apparatus 6 are then rotatable within a base support plate 4 by being attached to the precision bearing 22. When forces are applied to the disfigured wheel H, the forces are supported by the width of the adapter plate 7 and the mounting blocks 5 to which the adapter plate 7 is fixed, preserving the precision bearing 22 from damage by the forces applied to the disfigured wheel H. Also according to an embodiment of the present invention, the wheel reconditioning apparatus 1 includes a hydraulic arm assembly 17 that can be adjusted vertically, allowing a technician to recondition disfigured wheels of variable widths. The wheel reconditioning apparatus 1 provides for the reconditioning of disfigured wheels on a sturdy platform that preserves the bearings and that is adjustable for wheels of varying diameters and heights.

One skilled in the art will see that the present invention can be applied in many areas where there is a need to provide sturdy support during the wheel reconditioning process. For example, while an embodiment of the present invention uses a hydraulic arm with an attached ram to recondition the wheel, one skilled in the art will know that other methods can be employed to recondition a wheel using the present invention. It is well known in the art that for slight disfigurement, specialized hammers and wrenches are often used to recondition wheels. Additionally, in cases of serious disfigurement, heat is often applied to the wheel, through the use of a gas burner or blowtorch, before reconditioning the wheel to soften the metal before a usual hydraulic force is pressed against the rim. The present invention provides the necessary support for these methods of reconditioning a wheel without damage to the wheel reconditioning apparatus.

It should be apparent from the foregoing that an invention having significant advantages has been provided. While the invention is shown in only a few of its forms, it is not just limited but is susceptible to various changes and modifications without departing from the spirit thereof.

I claim:

1. A wheel reconditioning apparatus comprising:

adjustable chucks between which a wheel is to be mounted on its vertical axis, said adjustable chucks fixed to a chuck apparatus on chuck slides;

said chuck apparatus including a threaded insertion whereby said adjustable chucks move in a lateral direction when manipulated;

a rotatable adapter plate including a support attachment for a pneumatic wrench and said adjustable chucks attached to said chuck apparatus can be moved with the insertion of a fitted bolt using pneumatic pressure from said pneumatic wrench, said adapter plate being rotatable about the fixed vertical axis of a wheel mounted on said wheel reconditioning apparatus;

a base support plate within which said adapter plate is fixed to mounting blocks and supported by a bearing for supporting the rotation of said adapter plate; and a support frame on which said base support plate is fixed.

2. The wheel reconditioning apparatus according to claim 1 wherein:

said support frame includes a vertical support shaft, upon said vertical support shaft is attached a hydraulic arm for applying pressure to the wheel, upon said hydraulic arm is attached a ram in the approximate original form of the wheel.

3. The wheel reconditioning apparatus according to claim 2 wherein:

said vertical support shaft includes grooves along said support shaft so that said hydraulic arm is adjustable in a vertical direction along said support shaft, wherein said hydraulic arm is spring loaded into a groove at its desired height.

4. A wheel reconditioning apparatus comprising:

adjustable wheel chucks between which a wheel is to be mounted on its vertical axis;

a chuck base to which said adjustable wheels chuck are fixed;

a rotatable adapter plate on which said chuck base is set in place on said adapter plate, said adapter plate being rotatable about the vertical axis of a wheel mounted on said wheel reconditioning apparatus;

a chuck apparatus inside said adapter plate to which said chuck base is fixed and supported by a bearing, wherein said adapter plate includes a support attachment for a wrench and said adjustable chucks attached to said chuck apparatus can be moved by manipulating a threaded insertion of said chuck apparatus using the wrench supported by said wrench support attachment;

mounting blocks to which said adapter plate is fixed;

a base support plate within which said adapter plate is fixed to said mounting blocks, said mounting blocks fixed to a bearing within said base support plate, said adapter plate being supported by said bearing for supporting the rotation of said adapter plate and chuck apparatus; and a support frame on which said base support plate is fixed.

5. The wheel reconditioning apparatus according to claim 4 wherein:

said adjustable chucks are fixed to said chuck apparatus on chuck slides within said chuck apparatus, said chuck apparatus including said threaded insertion whereby said chuck slides move in a lateral direction when manipulated.

6. The wheel reconditioning apparatus according to claim 5 wherein:

said support frame includes a vertical support shaft, upon said vertical support shaft is attached a hydraulic arm for applying pressure to the wheel, upon said hydraulic arm is attached a ram, said ram having a rounded edge in the approximate original form of the wheel.

7. The wheel reconditioning apparatus according to claim 6 wherein:

said vertical support shaft includes grooves along said support shaft so that said hydraulic arm is adjustable in a vertical direction along said support shaft, wherein said hydraulic arm is spring loaded into a groove at its desired height.

* * * * *